United States Patent [19]

Parent

[11] Patent Number: 4,989,291

[45] Date of Patent: Feb. 5, 1991

[54] COMPUTER SERVICING CART

[75] Inventor: Richard Parent, Lake Bluff, Ill.

[73] Assignee: Alternative Resources Corporation, Lincolnshire, Ill.

[21] Appl. No.: 491,570

[22] Filed: Mar. 8, 1990

[51] Int. Cl.[5] ..... A47L 5/00

[52] U.S. Cl. ..... 15/315; 15/321; 15/323; 15/326; 15/339; 15/345; 280/47.19; 280/47.35

[58] Field of Search ..... 15/315, 321, 323, 326, 15/339, 345; 280/47.19, 47.35

[56] References Cited

U.S. PATENT DOCUMENTS

| | | | |
|---|---|---|---|
| D. 158,876 | 6/1950 | Lowell | 280/47.35 X |
| 1,681,624 | 8/1928 | Replogle | 15/323 |
| 3,401,420 | 9/1968 | Lofgren | 15/315 |
| 3,573,879 | 4/1971 | Bergkamp | 280/47.19 |
| 4,652,062 | 5/1987 | Greenwood | 280/47.35 X |
| 4,880,144 | 11/1989 | Shea | 15/339 X |

*Primary Examiner*—William A. Cuchlinski, Jr.
*Assistant Examiner*—James K. Folker
*Attorney, Agent, or Firm*—Hill, Van Santen, Steadman & Simpson

[57] ABSTRACT

There is disclosed herein a cart for computer cleaning. The cart includes a wheeled housing which defines a housing and a work surface at the top end of the frame. The housing includes a rear compartment in which a compressed gas unit, a retractable hose reel, a vacuum, and a retractable power cord are mounted. In addition, the housing includes an openable front compartment in which various tools are carried at convenient locations. The top of the cart carries a foldable work surface which may be folded to an open position wherein the computer components can be laid on the work surface. The frame defines a bottom well within which the hose reel may be partially positioned so as to lower the center of gravity and afford the cart with enhanced stability and reduce tipping susceptibility.

6 Claims, 3 Drawing Sheets

COMPUTER SERVICING CART

BACKGROUND OF THE INVENTION

This invention relates to work carts, and more specifically, to a cart for use in servicing and/or cleaning computer terminals.

Microcomputers and peripheral devices are becoming increasingly important in the workplace. For example, terminals or personal computers can be used in offices, engineering departments, and the like. From time to time it is necessary and desirable to clean these devices on site. Repair of the computers is normally done by removing the computer to an off-site location. Repair is different from cleaning or providing preventive maintenance. In order to clean the computers, it is necessary to clean parts, such as the keyboard, central processing unit and/or the printer by disassembly, vacuuming, closing, etc. Computer servicemen would clean these computers by carrying tools individually or in a satchel to the location for cleaning. In addition, it sometimes would be necessary for the servicemen to clean the unit at the desk or location of the PC, thus inconveniencing the operator or the organization of their work area.

It has been found to be desirable to provide a more compact way of reliably bringing tools, such as hand tools, cleaning solutions, a vacuum cleaner and/or a blowing apparatus to the work site. In addition it has been found to be desirable to provide a servicing work surface on which the workstation or its parts can be cleaned without disturbing the operator.

Therefore, it is an object of this invention to provide a self-contained apparatus which can be moved between servicing sites which can include most of the cleaning tools and apparatus.

It is another object of this invention to provide an auxiliary surface on which the computer component can be cleaned without inconveniencing the operator.

These and other objects of this invention will become apparent from the following disclosure and appended claims.

SUMMARY OF THE INVENTION

There is provided by this invention a stable, rollable cart for carrying the tools and implements necessary to clean a computer component or peripheral device and which includes a work surface on which components can be positioned for cleaning and not interfering with the work or work area of the computer operator.

The cart includes a wheeled housing and a work surface on the top end of the housing. The housing includes a rear compartment within which a compressed gas unit, retractable hose reel, vacuum and retractable power cord are mounted. In addition, the housing includes an openable front compartment within which various hand tools are carried at convenient locations. The top of the cart carries a foldable work surface which may be folded to an open position wherein the computer components can be laid on the work surface. The housing defines a bottom well within which the hose reel may be partially positioned so as to provide low center of gravity and afford the cart with enhanced stability and reduce tipping susceptibility. In addition, the rear wheels of the cart are located at a position so as to permit the cart to be moved up and down stairs.

Various outlets are provided for the compressed gas vacuum and electrical power supply. Various controls are provided for the vacuum apparatus. The interior of the rear compartment is coated with a foam insulation so as to reduce the noise created by operation of the vacuum.

DESCRIPTION OF THE PREFERRED EMBODIMENT

Figure 1:
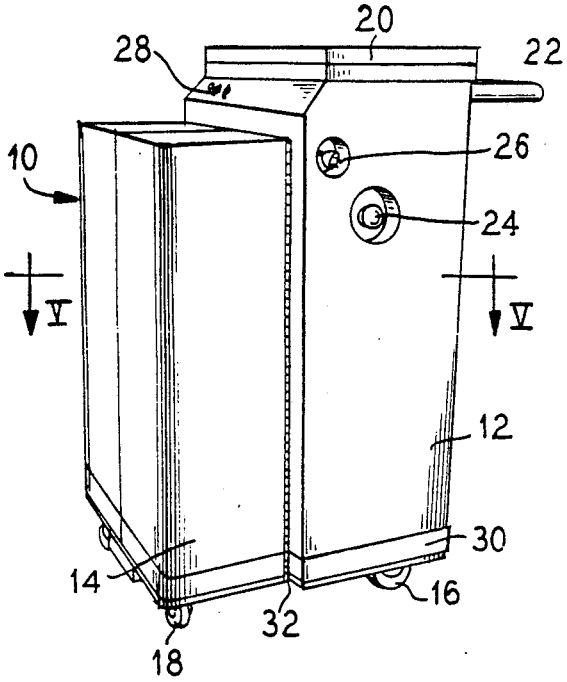
FIG. 1 shows a perspective view of a cart.

Referring now to FIG. 1, the cart 10 generally includes a housing, which defines a rear section 12 and a front section 14. The cart is provided with wheels such as the rear wheels 16 and front wheels 18. The rear wheels are large diameter wheels on an axle to absorb shock, whereas the front wheels are smaller wheels and are permitted to swivel. A foldable work surface 20 is provided at the top of the cart and the handle 22 is provided at the rear of the cart for pushing the same and supporting extensions of the work surface. For convenience, a vacuum outlet 24 is provided at one side of the housing and a electrical supply or inlet 26 is provided in the same side of the housing. Controls 28 generally ar provided at the front of the housing.

In general the cart is at about desk height whereby individuals won't have to bend or stoop over and the cart is comfortable to work at. Equipment can be easily transferred from the work area to the work surface and a minimum of lifting is required. Moreover, the cart can be fabricated from aluminum so that it is easily transportable in an office environment, the size is small enough to fit into tight spots, and it is never necessary to bring computer equipment to the cart as it is always possible to bring the cart to the equipment.

The work surface, such as 20, provides a surface to perform cleaning procedures without disrupting employees and the surface thereof includes a depression 21 to hold screws or other incidental small parts.

A rubber bumper, such as 30, can be provided about the periphery of the cart so as to minimize damage caused by the cart bumping into furniture or other items. Referring to the front of the cart, it is seen that the front section 14 is hinged along the piano-style hinge, such as 32, on both sides so as to open and provide a clamshell-like opening for parts **14*a* and 14*b*. The interior of the sections 14*a* and 14*b* includes brackets and shelves to provide a storage system for tools. For example, screwdrivers can be carried in a mounting, such as 34, and a static meter can be mounted on brackets such as 36. Other tools can be mounted in the front half 14***a*. Opening of the front half 14*a* exposes a T-shaped housing 37 from which a compressed gas, usually nitrogen, hose 38 and nozzle 39 extend through an aperture 40.

The opening of 14*a* and 14*b* also permits access to base storage as on surface 42 where spray bottles or other cleaners can be carried. If necessary, drawers or the like can be provided on the top surface 44 of the T. The electrical controls 28 include an indicator light 28*a*, which indicates that power is coming to the cart. A switch 28*b* for activating the vacuum cleaner is within the cart. A switch 28*c* can be provided for switching an electrical outlet.

Figure 2:
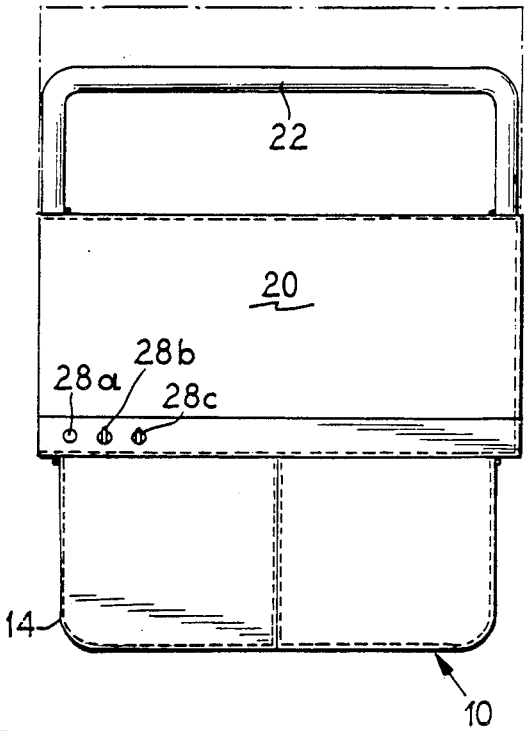
FIG. 2 shows a top view of the cart of FIG. 1 and the chain dot lines indicates the open position for the top work surface.
Figure 3:
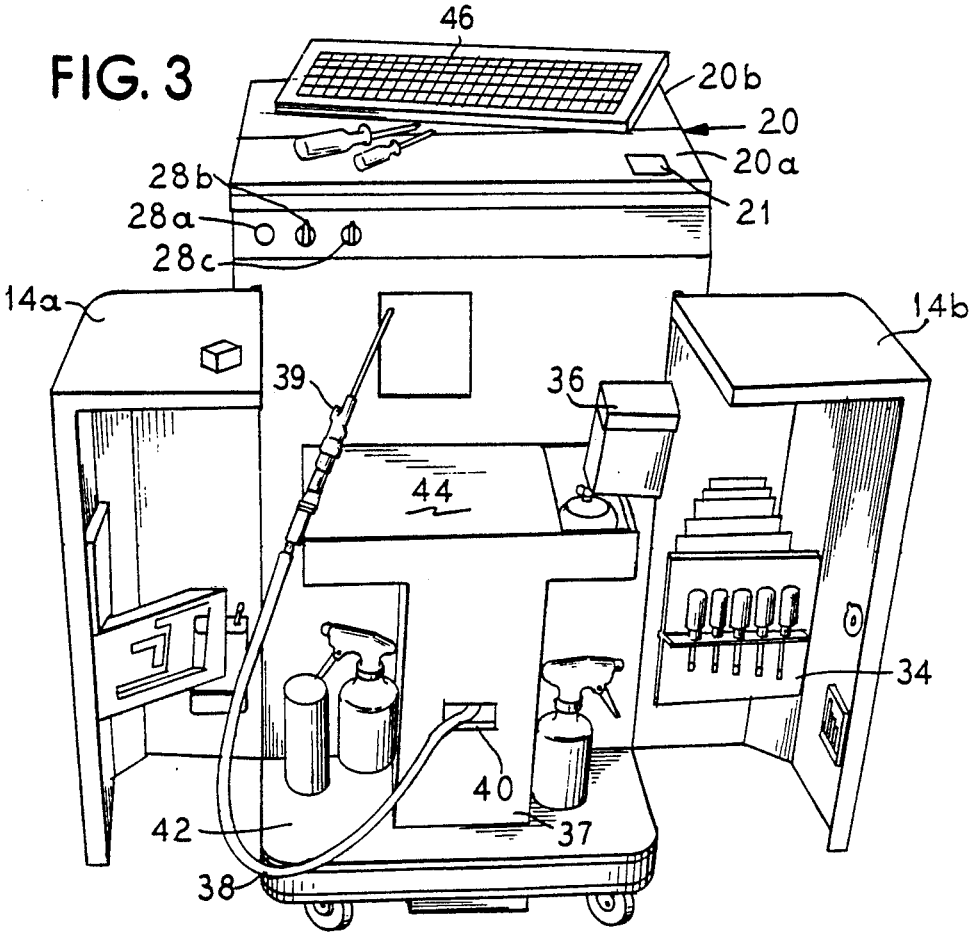
FIG. 3 is a perspective view of the front of the cart of FIG. 1 with the tool section open so as to expose the tools.
Figure 4:
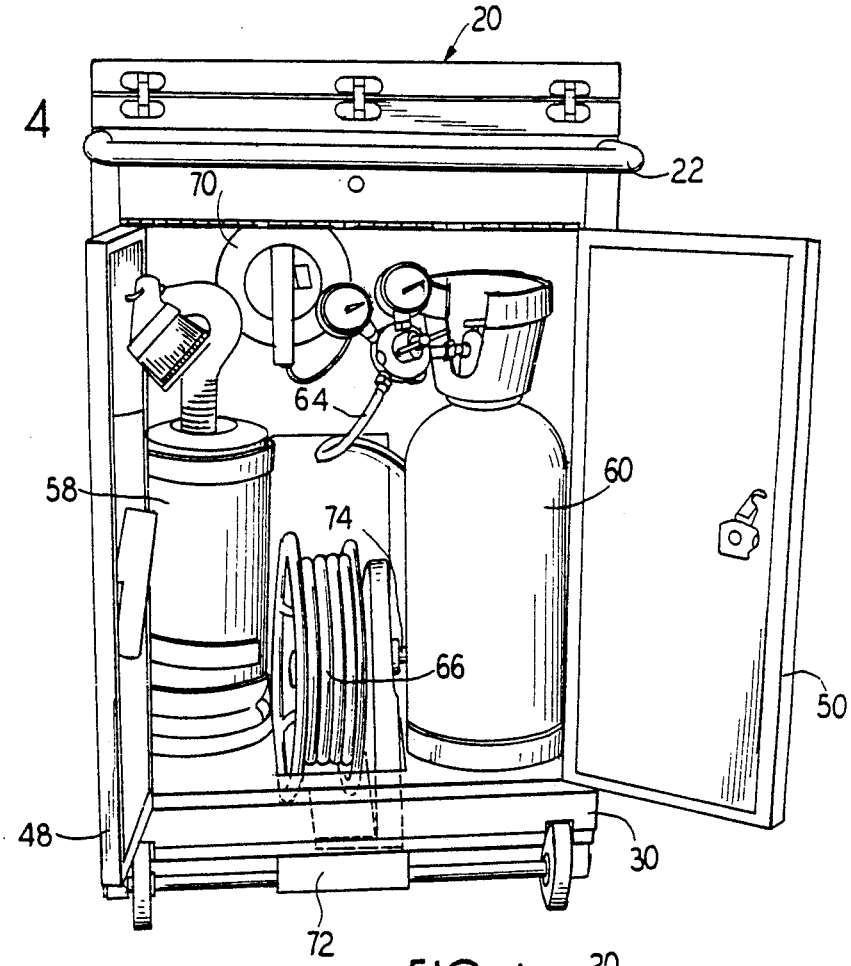
FIG. 4 is a rear elevational view of the cart of FIG. 1 showing the compressed air tank, hose reel and vacuum and coilless power cord positioned therein.
Figure 5:
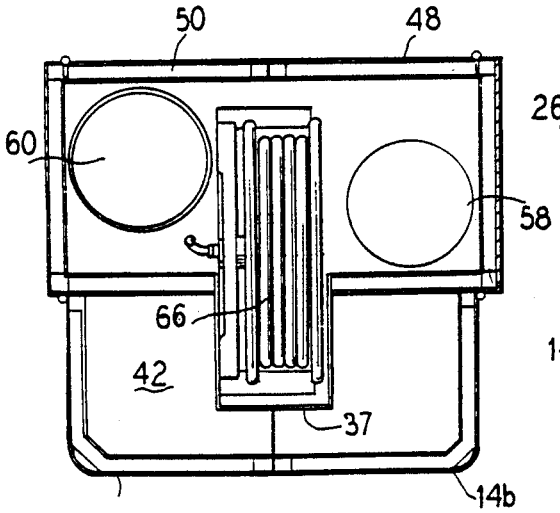
FIG. 5 is a plan sectional view taken along line V—V of FIG. 1 showing the positioning of the vacuum compressed gas tank and reel.

As shown in FIG. 3 the top 20 can be opened so as to provide sections 20*a* and 20*b* for supporting the working components such as a keyboard 46. FIG. 2 shows a top view of the cart and shows how the top work area can expand so as to rest on the cart handle 22.

Figure 6:
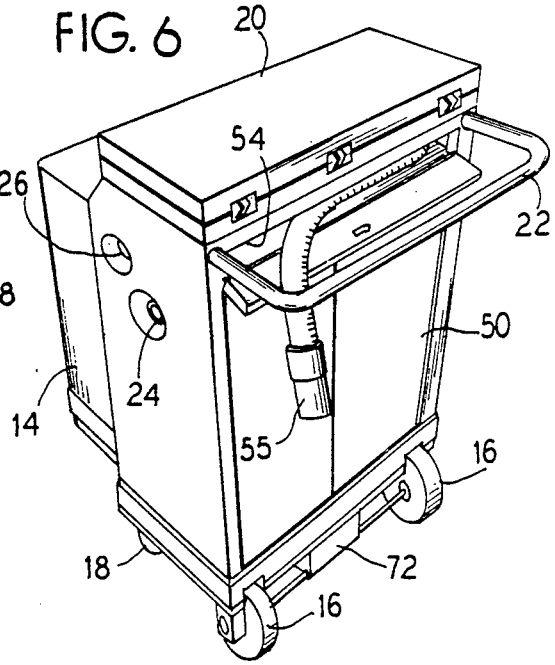
FIG. 6 is a perspective view of the cart of FIG. 1 showing the back thereof and the location of the vacuum

Referring now to the rear housing portion of the cart, the back of the cart is opened with doors such as 48 and 50. A swing-down compartment door 52 is provided for exposing the compartment within which a vacuum hose is stored. In FIG. 6 that compartment is shown as 54 and the hose is shown as 56.

Inside the back of the housing, there is mounted a vacuum container 58 which is connected to the vacuum outlet 24 on the side of the housing. On the right-hand side of the housing there is provided a compressed gas tank 60 which is connected to a regulator system 62 whereby the internal gas pressure, which is normally at about 2200 psi is reduced to a much lower level. The tank is secured to the housing for stability when the cart is moved. The regulator is connected to a hose 64 that interconnects to a hose reel 66. The hose extends into the front compartment, through the front, and to the nozzle 39 as shown in FIG. 3.

In addition an electric cord recoil reel is shown as 70, and the cord exits at opening 26. This permits provision of electric power to the cart.

The vacuum cleaner 58 is accessible from the interior/exterior workstation making it convenient to use and the vacuum itself provides a high suction rate by a 1½horsepower motor.

The compressed gas in tank 60 is a bottled gas. Mechanical air compressors have been found to be undesirable because of the build up of condensation and creation of unfavorable conditions for electronic devices. The gas bottle is generally aluminum so as to reduce weight and is small so as to fit in a cart rather than the large type found in industrial settings. The particular cylinders hold approximately thirty-seven cubic feet of nitrogen at about 2200 pounds of psi, and the quantity is sufficient to clean a large number of computers. Rotation of the hose reel permits extension of the hose so that it may reach the computer at its position or on the work surface.

Figure 7:
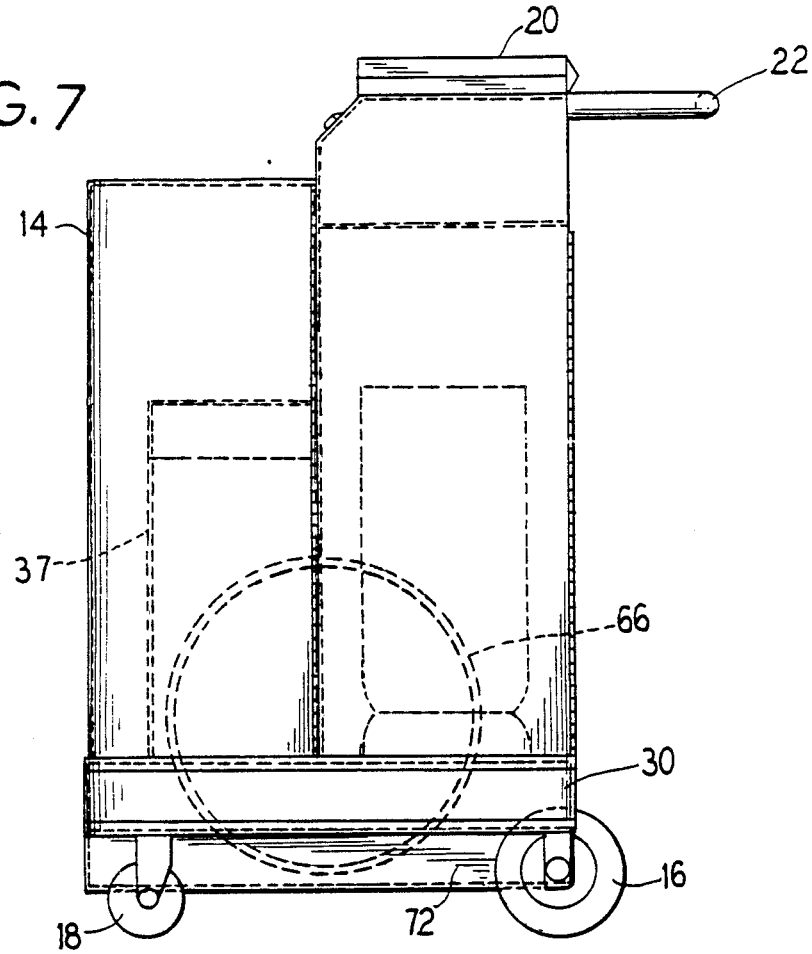
FIG. 7 is a side elevational of the cart in FIG. 1.

The housing includes a well or drop floor 72, and as shown in FIG. 7, the reel 66 fits in part into the well 72. The reel is rotatably mounted on a bracket within the housing at point 74. By providing the well, the center of rotation, and thus the center of gravity of hose reel, is lowered so as to maximize the stability of the cart.

The hose reel itself provides for a neat, professional appearance to the cart, while still permitting storage of hose and securement in the cart. The hose is twenty-five feet in length and can reach most cleaning operations. One of the advantages of the system is that at the end of the project the hose can be rewound on the reel, provide a neat appearance, the vacuum hose 56 can be stored in its compartment and the electric power cord can be pulled back into the recoil system.

The interior of the housing or rear compartment of the housing is coated with a foam insulation 75 so as to reduce the noise emanating from the cart an permit quiet operation in the office environment.

Figure 8:
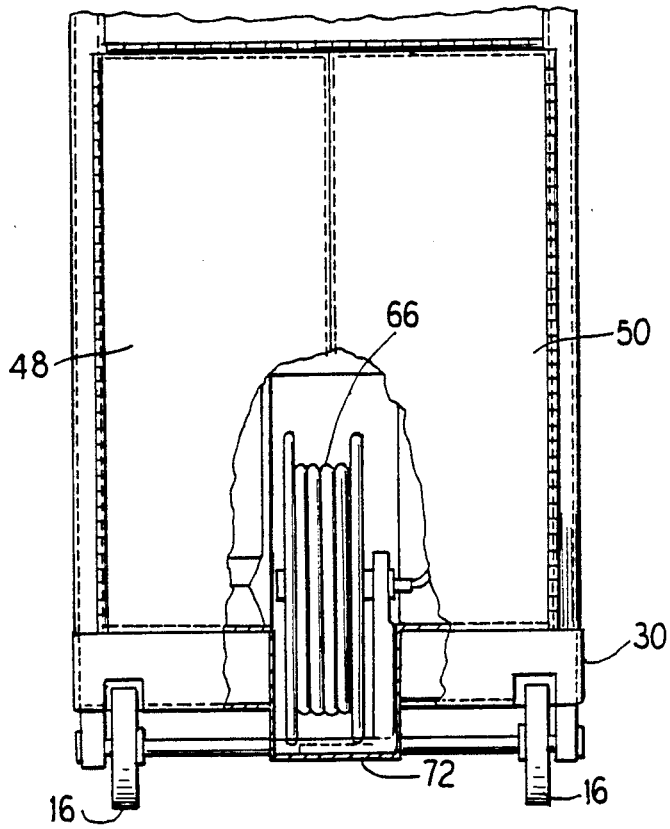
FIG. 8 is an enlarged elevational view of a section of a lower rear section of the cart.

From FIGS. 7 and 8, it can be seen that the rear wheel 16 is a large wheel located on an axle generally aligned with the rear wall of the cart and the bottom of the well. This permits the cart to be tipped, easily rolled, and raised and lowered up a flight of stairs. The front wheels 18 are of a small diameter, are entirely within the projection of the front compartment, and are swiveled or rotatable so as to be able to direct the movement of the cart.

Although the invention has been described with respect to preferred embodiments, it is not to be so limited as changes and modifications can be made which are within the full intended scope of the invention as defined by the appended claims.

I claim as my invention:

1. A portable cart for use in cleaning computer systems at remote locations which includes:

a housing mounted on wheels for movability wherein said housing includes a rear compartment and a front compartment, said rear compartment storing vacuum means, compressed gas means and compressed gas distribution hose means associated with the compressed gas means and an electric power means;

said compressed gas means being stored on one side of the housing, said vacuum means being stored on the other side of said housing; said compressed gas distribution hose means including a reel on which said hose means is stored positioned between the compressed gas means and vacuum means, said hose being extendable from said reel;

said housing having a floor and said floor defining a well therein which is aligned with the hose reel and at least a portion of the hose reel fits into the well so as to minimize the height of the hose reel relative to a support surface.

2. A portable cart for use in cleaning computer systems at remote locations which includes:

a housing, mounted on wheels for movability on a support surface wherein said housing includes a rear compartment and a front compartment, said rear compartment storing vacuum means, compressed gas means, and compressed gas distribution hose means associated with the compressed gas means, electric power means and having in a side thereof a vacuum outlet connected to said vacuum means;

a front compartment adjacent the rear compartment being openable and constructed to carry tools for cleaning a computer;

electric cord means associated with said power means, hose means associated with said compressed gas means and extendable into a front compartment;

an openable work surface on the top of the rear compartment and foldable rearwardly to an open position;

a handle associated with the rear compartment for moving of the cart and constructed to support the openable top;

wherein said compressed gas is stored in a bottle in the rear compartment on one side thereof, said vacuum means is stored on the other side of said rear compartment and said compressed gas hose means is stored on reel positioned between the bottle of gas and vacuum, and said hose being extendable from said reel; and wherein said cart includes a floor portion having a well or lower portion therein, which well is aligned with the hose reel and at least a portion of the hose reel fits into the well so as to minimize the height of the hose reel relative to a support surface.

3. A portable cart as in claim 2, wherein said rear compartment is accessible by a pair of doors in the rear thereof and insulation is applied to the interior of the rear compartment for minimizing sound transmitted from the compartment to positions external thereof.

4. A portable cart as in claim 3, wherein a vacuum hose storage compartment is defined in the rear compartment adjacent the work surface and is accessible through a compartment door mounted thereon.

5. A portable cart as in claim 1, wherein said work surface includes a well formed in the top surface thereof for holding small components of articles to be cleaned.

6. A portable cart as in claim 1, wherein said wheels include a pair of front caster means and a pair of rear wheels rotatably fixed at the rear of the cart, the center of rotation being generally aligned with the rear wall of the rear compartment and the bottom wall of the well and the rear wheel is larger in diameter than the front wheel.

* * * * *